US010360833B2

(12) United States Patent
Yi et al.

(10) Patent No.: US 10,360,833 B2
(45) Date of Patent: Jul. 23, 2019

(54) METHOD FOR CONTROLLING IMAGE DISPLAY AND TERMINAL

(71) Applicant: Guangdong Oppo Mobile Telecommunications Corp., Ltd., Dongguan, Guangdong (CN)

(72) Inventors: Yongpeng Yi, Guangdong (CN); Deliang Peng, Guangdong (CN); Shengjun Gou, Guangdong (CN); Xiaori Yuan, Guangdong (CN); Gaoting Gan, Guangdong (CN); Zhiyong Zheng, Guangdong (CN); Hai Yang, Guangdong (CN)

(73) Assignee: Guangdong Oppo Mobile Telecommunications Corp., Ltd., Dongguan (CN)

( * ) Notice: Subject to any disclaimer, the term of this patent is extended or adjusted under 35 U.S.C. 154(b) by 25 days.

(21) Appl. No.: 15/709,108

(22) Filed: Sep. 19, 2017

(65) Prior Publication Data

US 2018/0261140 A1 Sep. 13, 2018

(30) Foreign Application Priority Data

Mar. 10, 2017 (CN) ..... 2017 1 0141744

(51) Int. Cl.
*G09G 5/02* (2006.01)
*G09G 3/20* (2006.01)

(52) U.S. Cl.
CPC ..... *G09G 3/2003* (2013.01); *G09G 3/20* (2013.01); *G09G 2320/0233* (2013.01); *G09G 2320/0242* (2013.01); *G09G 2320/06* (2013.01); *G09G 2330/021* (2013.01); *G09G 2340/16* (2013.01); *G09G 2360/16* (2013.01)

(58) Field of Classification Search
CPC ..... G09G 2330/021; G09G 2320/16; G09G 3/3406
See application file for complete search history.

(56) References Cited

U.S. PATENT DOCUMENTS

2004/0252217 A1* 12/2004 Battles ..... H04N 5/232 348/333.01
2006/0250385 A1 11/2006 Plut
(Continued)

FOREIGN PATENT DOCUMENTS

CN 101866208 A 10/2010
CN 102903337 A 1/2013
(Continued)

OTHER PUBLICATIONS

Extended European Search Report issued in corresponding European Application No. 17191523.4 dated Jan. 29, 2018 (10 pp).
(Continued)

*Primary Examiner* — Nan-Ying Yang
(74) *Attorney, Agent, or Firm* — Young Basile Hanlon & MacFarlane, P.C.

(57) ABSTRACT

A method for controlling image display is provided. The method includes determining a target image display scheme based on at least one of a currently displayed image or a user operation, and processing and displaying a to-be-displayed image based on the target image display scheme. The target image display scheme may contain one or more parameters related to image display effects.

12 Claims, 9 Drawing Sheets

(56) References Cited

U.S. PATENT DOCUMENTS

| | | | | |
|---|---|---|---|---|
| 2010/0250984 | A1 | 9/2010 | Lee et al. | |
| 2011/0141366 | A1* | 6/2011 | Yoon | G09G 5/005 348/602 |
| 2012/0206475 | A1* | 8/2012 | Bryant | G11B 27/034 345/589 |
| 2014/0328548 | A1* | 11/2014 | Carpenter | G06T 5/007 382/274 |
| 2015/0179123 | A1 | 6/2015 | Derckx et al. | |

FOREIGN PATENT DOCUMENTS

| | | | |
|---|---|---|---|
| CN | 103050108 | A | 4/2013 |
| CN | 103294158 | A | 9/2013 |
| CN | 103631359 | A | 3/2014 |
| CN | 104049710 | A | 9/2014 |
| CN | 104064163 | A | 9/2014 |

OTHER PUBLICATIONS

International Search Report issued in corresponding International Application No. PCT/CN2017/101739 dated Nov. 30, 2017 (12 pp).

* cited by examiner

METHOD FOR CONTROLLING IMAGE DISPLAY AND TERMINAL

CROSS-REFERENCE TO RELATED APPLICATION(S)

This application claims priority to Chinese Patent Application No. 201710141744.9, filed on Mar. 10, 2017, the content of which is hereby incorporated by reference in its entirety.

TECHNICAL FIELD

The present disclosure relates to terminals, and particularly to a method for controlling image display and a terminal.

BACKGROUND

Presently, terminals such as smart phones may include various applications, thus various scenes (a game scene, a chatting scene, and so on) may be displayed on the terminals. The terminals may adopt a fixed image display scheme which contains one or more parameters related to display effects to display different scenes, and by means of which, it may be difficult to maintain a balance between power saving and good display effects.

BRIEF DESCRIPTION OF THE DRAWINGS

In order to illustrate the technical solutions of the implementations of the present disclosure more clearly, the drawings used in the description of the implementations will be briefly described, it will be apparent that the drawings described in the following are implementations of the present disclosure, and it will be apparent to those skilled in the art that other drawings can be obtained from the drawings without any creative work.

DETAILED DESCRIPTION

In order to illustrate the technical solutions of the present disclosure or the related art more clearly, a brief description of the accompanying drawings used herein is given below. Obviously, the drawings listed below are only examples, and a person skilled in the art should be noted that, other drawings can also be obtained on the basis of these exemplary drawings without creative work.

In the following description, numerous specific details are set forth in order to facilitate a thorough understanding of the present disclosure, however, the present disclosure can be practiced otherwise than as specifically described herein, and therefore, the scope of the present disclosure is not to be limited to the specific implementations disclosed below.

Figure 1:
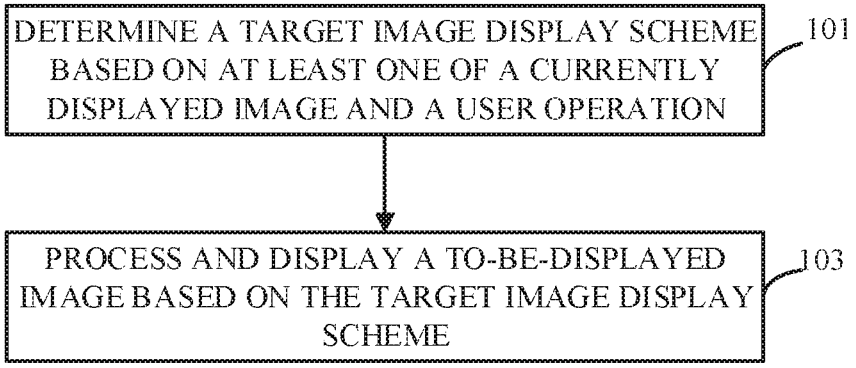
FIG. 1 is a method for controlling image display in accordance with an implementation of the present disclosure.

FIG. 1 is a flowchart of a method for controlling image display in accordance with an implementation of the present disclosure. The method is applied to a terminal. The terminal may be a mobile phone, a tablet computer, a personal digital assistant, a handheld game player, or other. The method may include the follows.

At block 101, a target image display scheme is determined based on at least one of a currently displayed image and a user operation. That is, the target image display scheme may be determined based on the currently displayed image, or based on the user operation, or based on the currently displayed image and the user operation. The target image display scheme contains one or more parameters related to image display effects. The image display effects may be that an image is displayed with a high resolution, images are refreshed quickly, and so on.

In an implementation, one or more parameters contained in each image display scheme may be preset based on fidelity optimized signal scaling (FOSS) technology. One or more parameters contained in each display scheme may include a color value, a transparency value, a contrast value, a gray value, a refresh rate, and so on.

In at least one alternative implantation, one or more parameters contained in each image display scheme may be preset based on content adaptive brightness control (CABC) technology. One or more parameters contained in each display scheme may include a color value, a transparency value, a gray value, a brightness of the backlight, and so on.

In an implementation, determining the target image display scheme based on the currently displayed image may include the follows. The target image display scheme is determined based on property information of the currently displayed image and a relationship between image property information and image display schemes. The property information of the currently displayed image may include a color value, a transparency value, a brightness value, a gray value, and so on. The relationship between image property information and image display schemes may be that each image display scheme corresponds to one or more property ranges. For example, each image display scheme corresponds to a color value range, or corresponds to a color value range and a transparency value range. When the property information of the currently displayed image falls within a property range corresponding to an image display scheme, the image display scheme is determined to be the target image display scheme. For example, when the color value of the currently displayed image falls within a color value range corresponding to an image display scheme, the image display scheme is determined to be the target image display scheme. For another example, when the color value and the transparency value of the currently displayed image respectively fall within a color value range and a transparency value range corresponding to an image display scheme, the image display scheme is determined to be the target image display scheme.

In the implementation, the target image display scheme is determined based on the property information of the currently displayed image, thus different scenes may be displayed by different image display schemes to provide better display effects.

Figure 2:
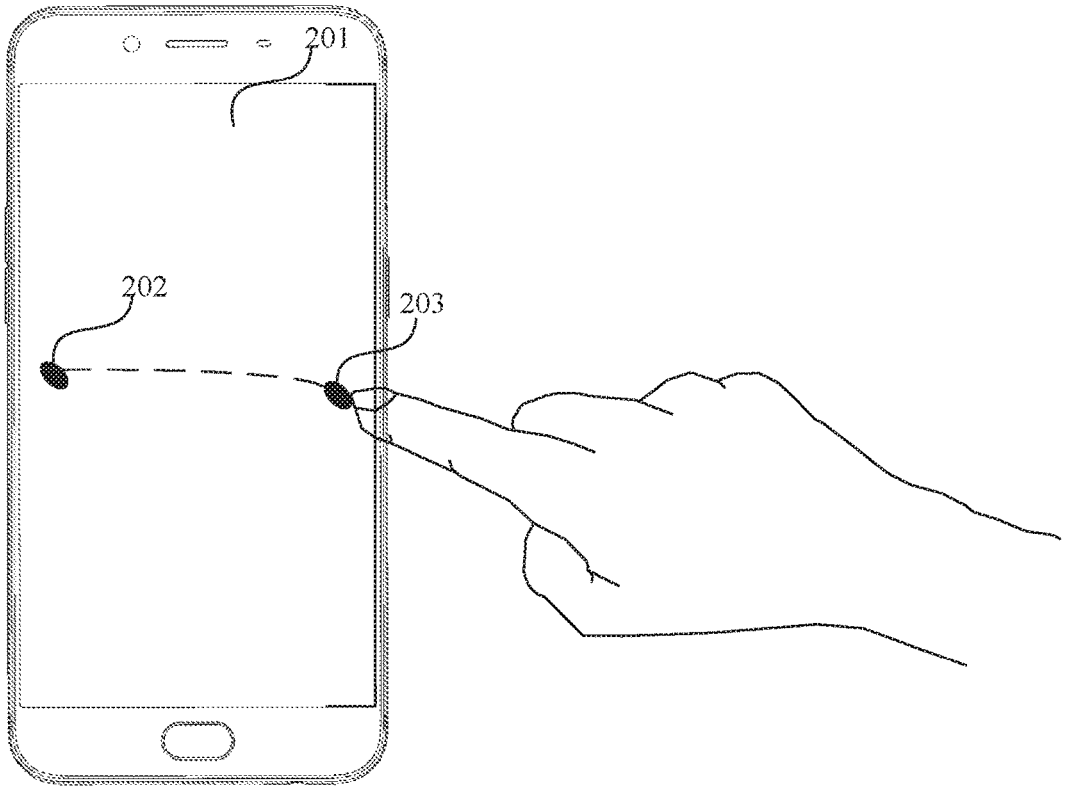
FIG. 2 is a schematic view showing a user operation in accordance with an implementation of the present disclosure.
Figure 3:
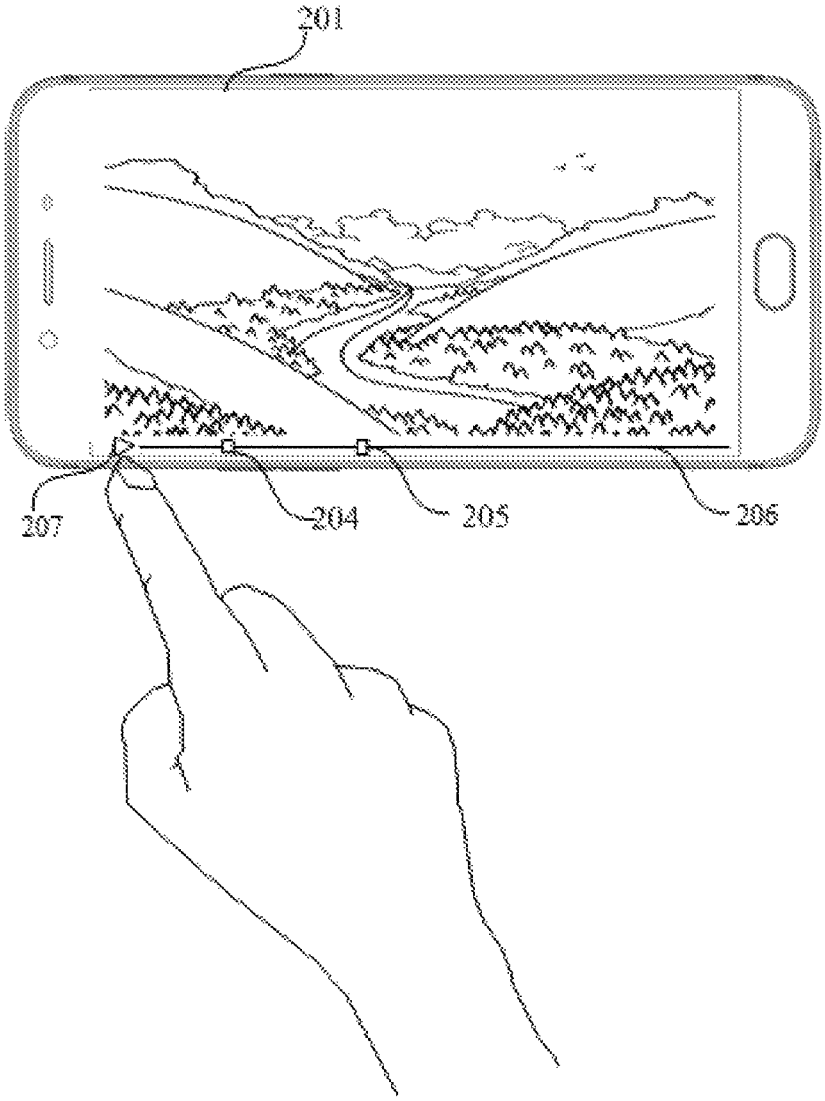
FIG. 3 is a schematic view showing a user operation in accordance with another implementation of the present disclosure.

In at least one implementation, determining the target image display scheme based on the user operation may include the follows. The target image display scheme is determined based on the type of the user operation and a relationship between types of user operation and image display schemes. The user operation may be an operation of switching images at a high speed and an operation of switching images at a low speed. That is, the image display scheme determined when switching images quickly is different from that determined when switching images slowly. For example, as illustrated in FIGS. 2-3, the user operation may be an operation of sliding from a start point 202 at a side of a screen 201 toward an endpoint 203 at an opposite side of the screen 201 slowly, or an operation of clicking a fast forward button 207 quickly to move from a first position 204 of a progress bar 206 to a second position 205, and the present disclosure is not limited thereto.

In this implementation, the relationship between types of user operation and image display schemes may be that different types of user operation correspond to different image display schemes. When the type of the user operation is determined, the target image display scheme is determined based on the relationship between types of user operation and image display schemes. For example, when the user operation is the operation of switching images quickly, it may indicate that a user just wants to browse images quickly rather than viewing each image carefully, so an image display scheme which may cause power consumption to be low may be selected. When the user operation is the operation of switching images slowly, it may indicate that the user wants to view each image carefully, so an image display scheme which can provide better display effects may be selected.

In at least one alternative implementation, determining the target image display scheme based on the currently displayed image and the user operation may include the follows. A first image display scheme is determined based on property information of the currently displayed image and a relationship between image property information and image display schemes, and a power saving level corresponding to the first image display scheme is determined based on a relationship between power saving levels and image display schemes. A higher power saving level indicates less power consumption. Furthermore, a second image display scheme is determined based on the type of the user operation and a relationship between types of user operation and image display schemes, and a power saving level corresponding to the second image display scheme is determined based on the relationship between power saving levels and image display schemes. The first image display scheme is then determined to be the target image display scheme when the power saving level corresponding to the first image display scheme is higher than that corresponding to the second image display scheme, and the second image display scheme is then determined to be the target image scheme when the power saving level corresponding to the second image display scheme is higher than that corresponding to the first image display scheme. Certainly, when the power saving level corresponding to the first image display scheme is the same as that corresponding to the second image display scheme, the first image display scheme or the second image display scheme may be selected.

In this implementation, when an image display scheme is determined, a corresponding power saving level is also determined. The target image display scheme is displayed further based on the power saving levels. Thus, an image display scheme with lower power consumption can be employed to save power.

In an implementation, the target image display scheme is determined every time after a preset period, and by means of which, power can be further saved. For example, when playing a video, the used image display scheme during the playing of the video may be the same, so there is no need to change the image display scheme. Thus, by means of determining the target image display scheme every time after the preset period, power can be saved.

In an implementation, various manners may be used to acquire the currently displayed image. For example, data in a frame buffer may be read via a process, and then the data is stored as a screen capture, that is, stored as the currently displayed image.

Figure 4:
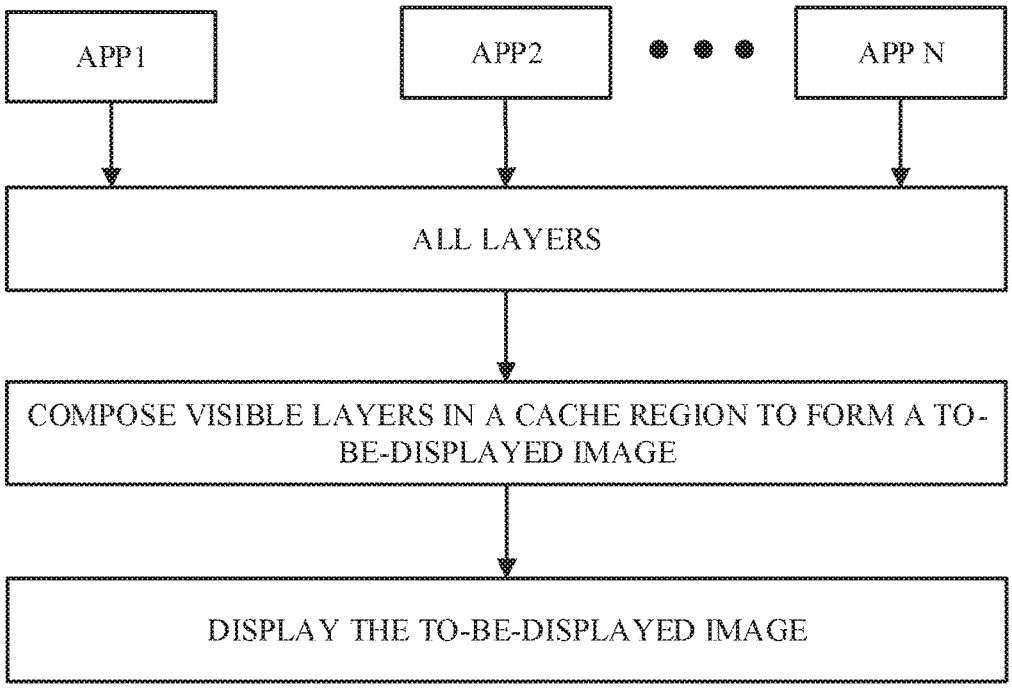
FIG. 4 is a schematic view showing a display process in accordance with an implementation of the present disclosure.
Figure 5:
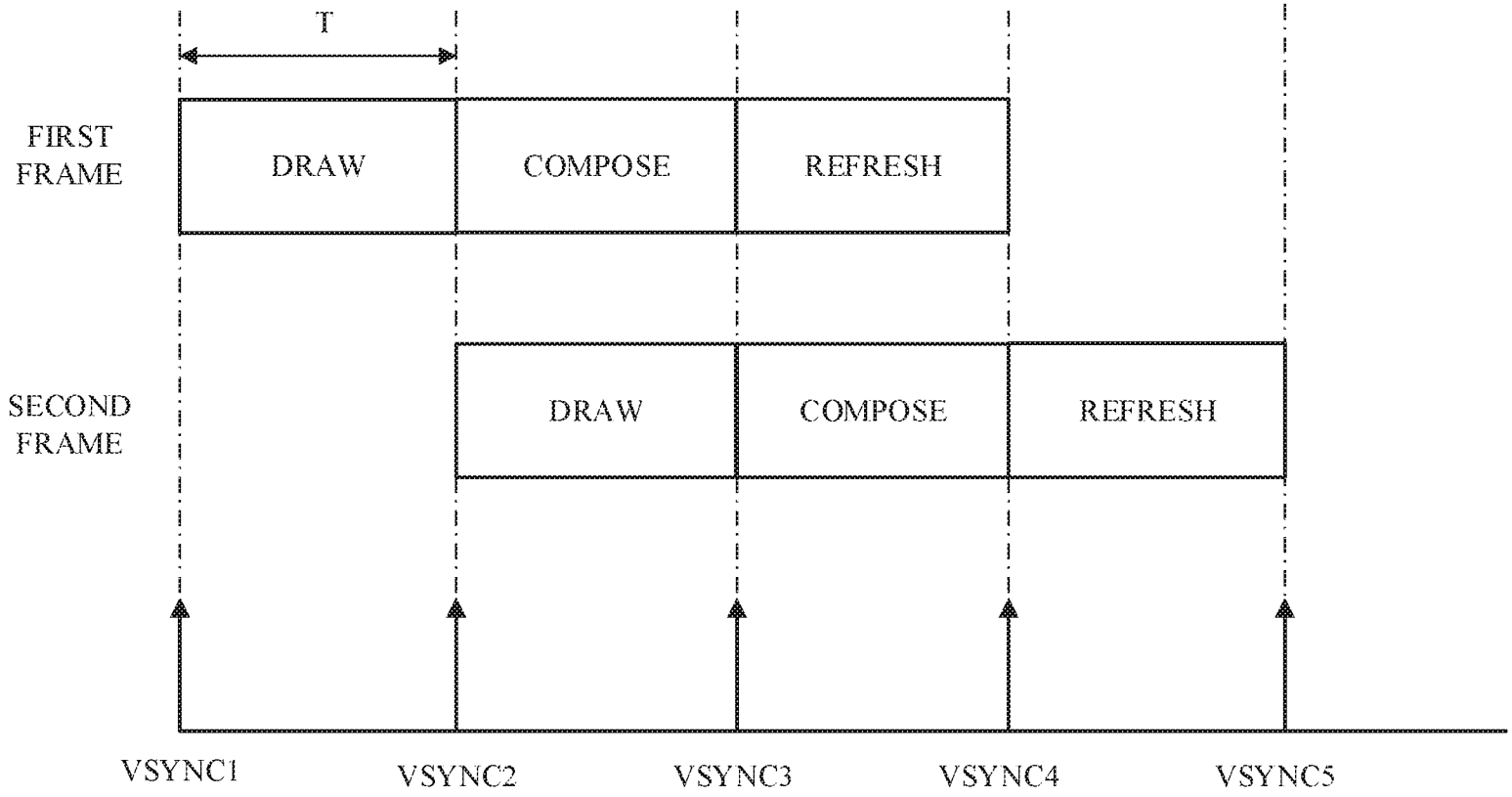
FIG. 5 is a schematic view showing a Vsync display refresh mechanism in accordance with an implementation of the present disclosure.

FIGS. 4-5 illustrate image generation and image display in accordance with an implementation of the present disclosure.

Referring to FIG. 4, each application may include one or more layers. An application executes a layer drawing operation (that is, drawing images on layers) based on a corresponding installation package. After the layer drawing operation, the application transmits the layers to the layer composition unit to perform the layer composition operation.

In the framework layer, all layers (including visible layers and invisible layers) constitute a layer list defined as ListAll. The layer composition unit selects the visible layers to form a visible layer list defined as DisplayList. The layer composition unit selects an unoccupied frame buffer (FB) from three FBs which are used in turn, and in the unoccupied FB the layers of the DisplayList are laminated together to obtain a to-be-displayed image based on application configuration information. The application configuration information may include which layer is on the bottom, which layer is on the top, which region is visible, which region is transparent, and so on.

Finally, in a kernel layer, the to-be-displayed image is transmitted to a display hardware (including a display controller and the display screen) to display the to-be-displayed image.

Referring to FIG. 5, a Vsync display refresh mechanism is displayed. The Vsync display refresh mechanism is that in a display process (e.g., the whole display process), Vsync signals are inserted and transmitted to a processor (CPU) via the display controller to generate Vsync interrupts, such that each layer drawing operation and each layer composition operation are needed to be performed according to the Vsync signals, whereby at least some operations (e.g., key operations) of the display process belong to a Vsync management mechanism. The frequency of the Vsync signal is 60 Hz. As illustrated in FIG. 4, it is assumed that the period of the Vsync signal is T, without consideration of transmission delay, after a first Vsync signal (Vsync1) reaches the CPU, the CPU transmits the Vsync1 to the currently running application. The currently running application responds to a user operation such as a sliding operation to begin the layer drawing operation. After the layer drawing operation, multiple layers are obtained. After a second Vsync signal (Vsync2) reaches the CPU, the CPU transmits the Vsync2 to the layer composition unit, and the layer composition unit begins to execute the layer composition operation to generate a to-be-displayed image. After a third Vsync signal (Vsync3) reaches the CPU, the refresh operation is executed to display the to-be-displayed image on the display screen. For the above description, it can be known that the frequencies of the Vsync signals received by the currently running application, the layer composition unit, and the display screen are the same.

In the process of generating an image to displaying an image, three rates may be employed. The rates may include a drawing frame rate, a composition frame rate, and a refresh rate.

The drawing frame rate is a frame rate to perform a layer drawing operation, and it may indicate layer frames are drawn in a unit time (for example, one second). The drawing frame rate may include a drawing frame rate of an application and a drawing frame rate of a layer. Each application may include multiple layers. For example, a video player may include three layers: a layer for displaying video content which is defined as U1 and two layers of SurfaceView type, one is for displaying bullet content which is defined as U2, and the other is for displaying user interface widgets (for example, a progress bar, a volume control bar, various control buttons, and so on) and broadcasts which is defined as U3. The drawing frame rate of an application is the number of times that the application executes the layer drawing operation in a unit time. When one layer drawing operation is performed, one or more layers may be drawn.

The composition frame rate is a frame rate in which the layers drawn by an application is composed as a to-be-displayed image, and the composition frame rate can be understood to be the number of image frames composed in a time unit.

Generally, the terminal will refresh the displayed image in the refresh rate of 60 Hz.

At block 103, a to-be-displayed image is processed and displayed based on the target image display scheme.

Figure 6:
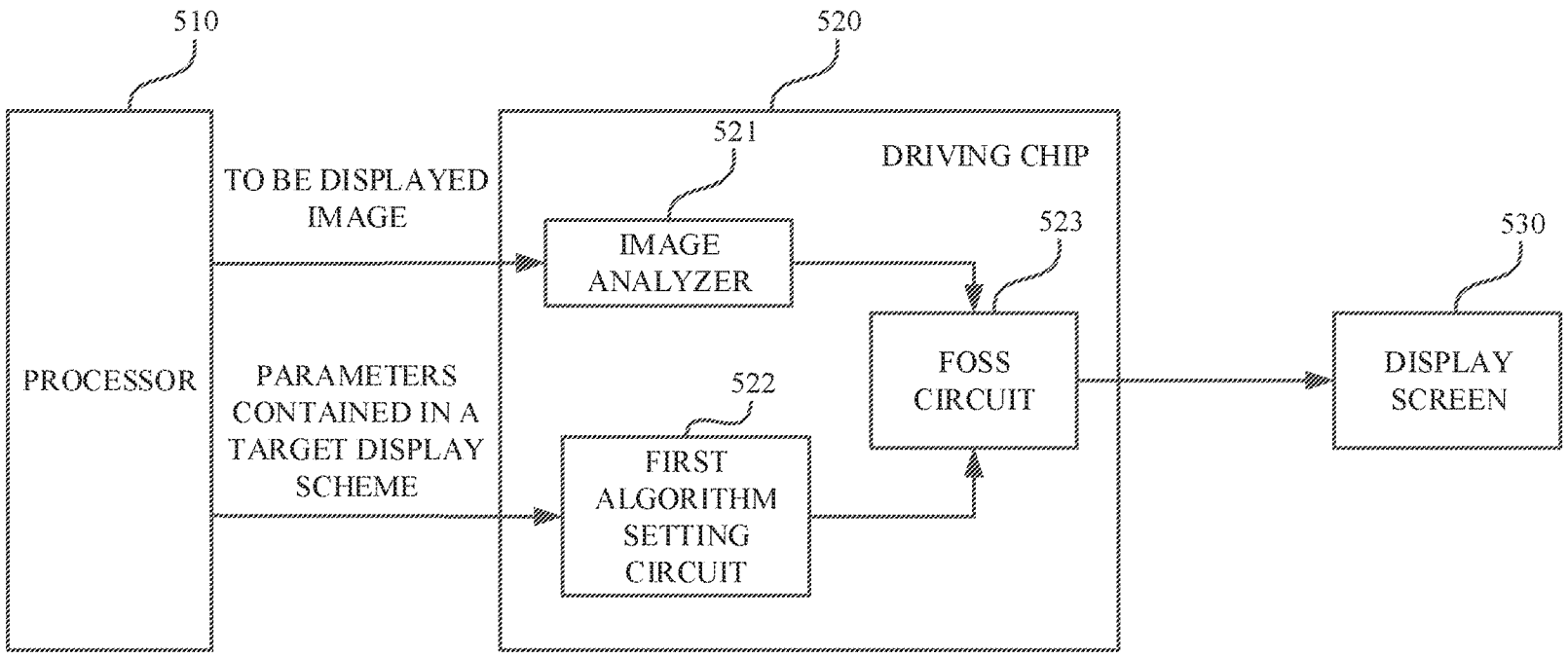
FIG. 6 is a display mechanism based on fidelity optimized signal scaling (FOSS) technology in accordance with an implementation of the present disclosure.

In an implantation, when one or more parameters contained in each image display scheme is preset based on FOSS technology, a display mechanism may be illustrated in FIG. 6. Data for forming a to-be-displayed image is transmitted by a processor 510 to an image analyzer 521 of a driving chip 520 of a display screen 530, and the one or more parameters contained in the target display scheme is also transmitted by the processor 510 to a first algorithm setting circuit 522. The image analyzer 521 analyzes the data received from the processor 510 to obtain property information of the to-be-displayed image. The property information of the to-be-displayed image is transmitted to a FOSS circuit 523. The FOSS circuit 523 employs a preset algorithm to adjust the property information of the to-be-displayed image based on the one or more parameters contained in the target displayed scheme. For example, gray values of some pixel points are adjusted. The processed to-be-displayed image is then transmitted to the display screen 530 for display. The display screen 530 may be an organic light emitting display (OLED) screen, an active matrix/organic light emitting diode screen, or the like.

Figure 7:
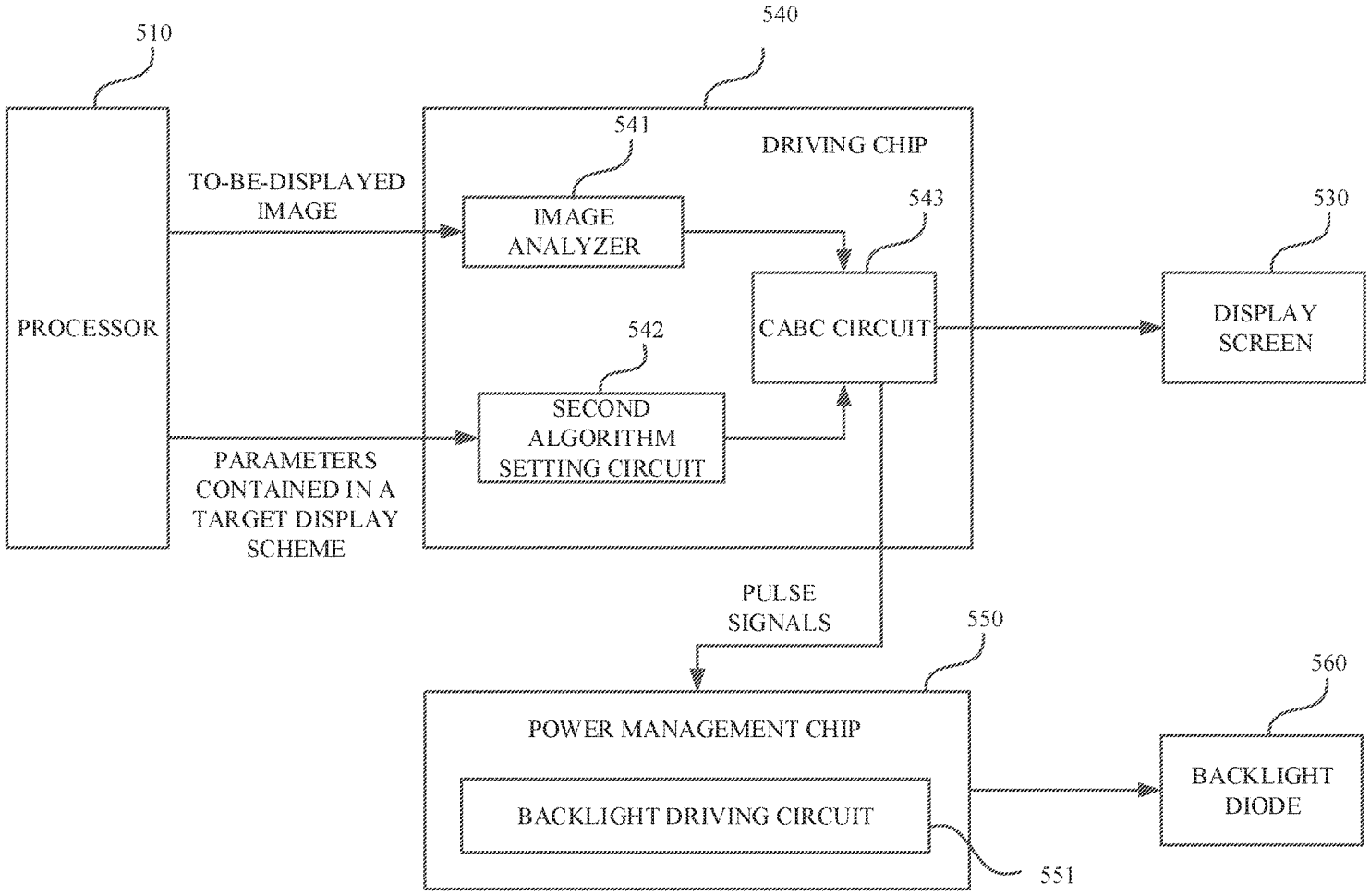
FIG. 7 is a displayed mechanism based on content adaptive brightness control (CABC) technology in accordance with an implementation of the present disclosure.

In at least one alternative implantation, when one or more parameters contained in each image display scheme is preset based on CABC technology, a display mechanism may be illustrated in FIG. 7. Data for forming a to-be-displayed image is transmitted by the processor 510 to an image analyzer 541 of a driving chip 540 of the display screen 530, and the one or more parameters contained in the target display scheme is also transmitted by the processor 510 to a second algorithm setting circuit 542. The image analyzer 541 analyzes the data received from the processor 510 to obtain property information of the to-be-displayed image. The property information of the to-be-displayed image is transmitted to a CABC circuit 543. The CABC circuit 543 employs a preset algorithm to adjust the property information of the to-be-displayed image based on the one or more parameters contained in the target displayed scheme. For example, gray values of some pixel points are adjusted. Furthermore, the CABC circuit 543 outputs pulse signals to a power management chip 550. The power management chip 550 controls a backlight driving circuit 551 to output waves based on a preset algorithm. The waves are used to control the brightness of backlight diodes 560 of the display screen 530. For example, the CABC circuit 543 increases the gray value of the to-be-displayed image by 30%, and the power management chip 550 decreases the brightness of the backlight by 30%. Thus, the display effects are not affected, and power saving is realized.

Figure 8:
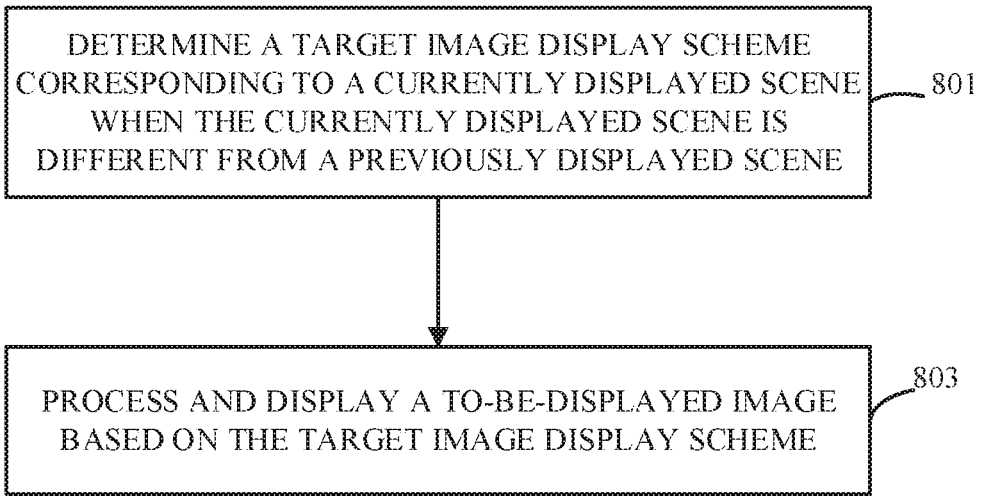
FIG. 8 is a method for controlling image display in accordance with another implementation of the present disclosure.

FIG. 8 is a flowchart of a method for controlling image display in accordance with another implementation of the present disclosure. The method may include the follows.

At block 801, a target image display scheme corresponding to a currently displayed scene is determined when the currently displayed scene is different from a previously displayed scene. The target image display scheme contains one or more parameters related to image display effects.

Various manners can be employed to determine the currently displayed scene. For example, one or more process identifiers of an application can be used to determine the currently displayed scene, and the present disclosure is not limited thereto. The currently displayed scene may be a video scene, a game scene, a chatting scene, or other.

In the implementation, the target image display scheme may be determined based on property information of a currently displayed image and a relationship between image property information and image display schemes, or based on the type of a user operation and a relationship between types of user operation and image display schemes, or based on both of the property information of the currently displayed image and the type of the user operation, which are illustrated in FIG. 1 and will not be repeated herein.

At block 803, a to-be-displayed image is processed and displayed based on the target image display scheme. The process at block 803 may correspond to the process at block 103.

In the implementation, when the currently displayed scene is different from the previously displayed scene, it indicates that the image display scheme may need to be changed. Thus, adopting the target image display scheme when the displayed scene is changed, image display effects may be much better.

Figure 9:
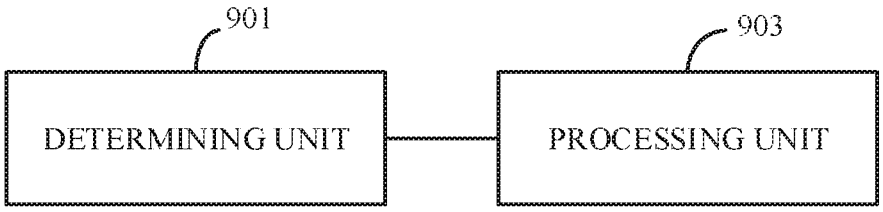
FIG. 9 is a block diagram of a terminal in accordance with an implementation of the present disclosure.

FIG. 9 is a block diagram of a terminal in accordance with an implementation of the present disclosure. The terminal may include a determining unit 901 and a processing unit 903.

The determining unit 901 may be configured to determine a target image display scheme based on at least one of a currently displayed image and a user operation. That is, the target image display scheme may be determined based on the currently displayed image, or based on the user operation, or based on the currently displayed image and the user operation. The target image display scheme contains one or more parameters related to image display effects.

In an implementation, one or more parameters contained in each image display scheme may be preset based on FOSS technology. One or more parameters contained in each display scheme may include a color value, a transparency value, a contrast value, a gray value, a refresh rate, and so on.

In at least one alternative implantation, one or more parameters contained in each image display scheme may be preset based on CABC technology. One or more parameters contained in each display scheme may include a gray value, a transparency value, a brightness of the backlight, and so on.

In an implementation, determining the target image display scheme based on the currently displayed image may include the follows. The target image display scheme is determined based on property information of the currently displayed image and a relationship between image property information and image display schemes. The property information of the currently displayed image may include a color value, a transparency value, a brightness value, a gray value, and so on. The relationship between image property information and image display schemes may be that each image display scheme corresponds to one or more property ranges. For example, each image display scheme corresponds to a color value range, or corresponds to a color value range and a transparency value range. When the property information of the currently displayed image falls within a property range corresponding to an image display scheme, the image display scheme is determined to be the target image display scheme. For example, when the color value of the currently displayed image falls within a color value range corresponding to an image display scheme, the image display scheme is determined to be the target image display scheme. For another example, when the color value and the transparency value of the currently displayed image respectively fall within a color value range and a transparency value range corresponding to an image display scheme, the image display scheme is determined to be the target image display scheme.

In the implementation, the target image display scheme is determined based on the property information of the currently displayed image, thus different scenes may be displayed by different image display schemes to provide better display effects.

In at least one implementation, determining the target image display scheme based on the user operation may include the follows. The target image display scheme is determined based on the type of the user operation and a relationship between types of user operation and image display schemes. The user operation may be an operation of switching images at a high speed and an operation of switching images at a low speed. That is, the image display scheme determined when switching images quickly is different from that determined when switching images slowly.

In this implementation, the relationship between types of user operation and image display schemes may be that different types of user operation correspond to different image display schemes. When the type of the user operation is determined, the target image display scheme is determined based on the relationship between types of user operation and image display schemes. For example, when the user operation is the operation of switching images quickly, it may indicate that a user just wants to browse images quickly rather than viewing each image carefully, so an image display scheme which may cause power consumption to be low may be selected. When the user operation is the operation of switching images slowly, it may indicate that the user wants to view each image carefully, so an image display scheme which can provide better display effects may be selected.

In at least one alternative implementation, determining the target image display scheme based on the currently displayed image and the user operation may include the follows. A first image display scheme is determined based on property information of the currently displayed image and a relationship between image property information and image display schemes, and a power saving level corresponding to the first image display scheme is determined based on a relationship between power saving levels and image display schemes. A higher power saving level indicates less power consumption. Furthermore, a second image display scheme is determined based on the type of the user operation and a relationship between types of user operation and image display schemes, and a power saving level corresponding to the second image display scheme is determined based on the relationship between power saving levels and image display schemes. The first image display scheme is then determined to be the target image display scheme when the power saving level corresponding to the first image display scheme is higher than that corresponding to the second image display scheme, and the second image display scheme is then determined to be the target image scheme when the power saving level corresponding to the second image display scheme is higher than that corresponding to the first image display scheme. Certainly, when the power saving level corresponding to the first image display scheme is the same as that corresponding to the second image display scheme, the first image display scheme or the second image display scheme may be selected.

In this implementation, when an image display scheme is determined, a corresponding power saving level is also determined. The target image display scheme is displayed further based on the power saving levels. Thus, an image display scheme with lower power consumption can be employed to save power.

In an implementation, the target image display scheme is determined every time after a preset period, and by means of which, power can be further saved. For example, when playing a video, the used image display scheme during the playing of the video may be the same, so there is no need to change the image display scheme. Thus, by means of determining the target image display scheme every time after the preset period, power can be saved.

In at least one alternative implementation, the determining unit 901 may be configured to determine a target image display scheme corresponding to a currently displayed scene when the currently displayed scene is different from a previously displayed scene. When the currently displayed scene is different from the previously displayed scene, it indicates that the image display scheme may need to be changed. Thus, adopting the target image display scheme when the displayed scene is changed, image display effects may be much better.

The processing unit 903 may be configured to process and display a to-be-displayed image based on the target image display scheme.

It shall be noted that the terminal described in the device implementation of the present disclosure is illustrated in the form of functional units. The term "unit" used herein shall be taken in the broadest possible sense. Objects for realizing the function of each unit may be an application specific integrated circuit (ASIC), a circuit (e.g., a single circuit), a processor (shared, specific, or chipset) for executing one or more software or hardware procedures in a memory, a combined logic circuit, and/or other appropriate assembly for realizing the above function.

Figure 10:
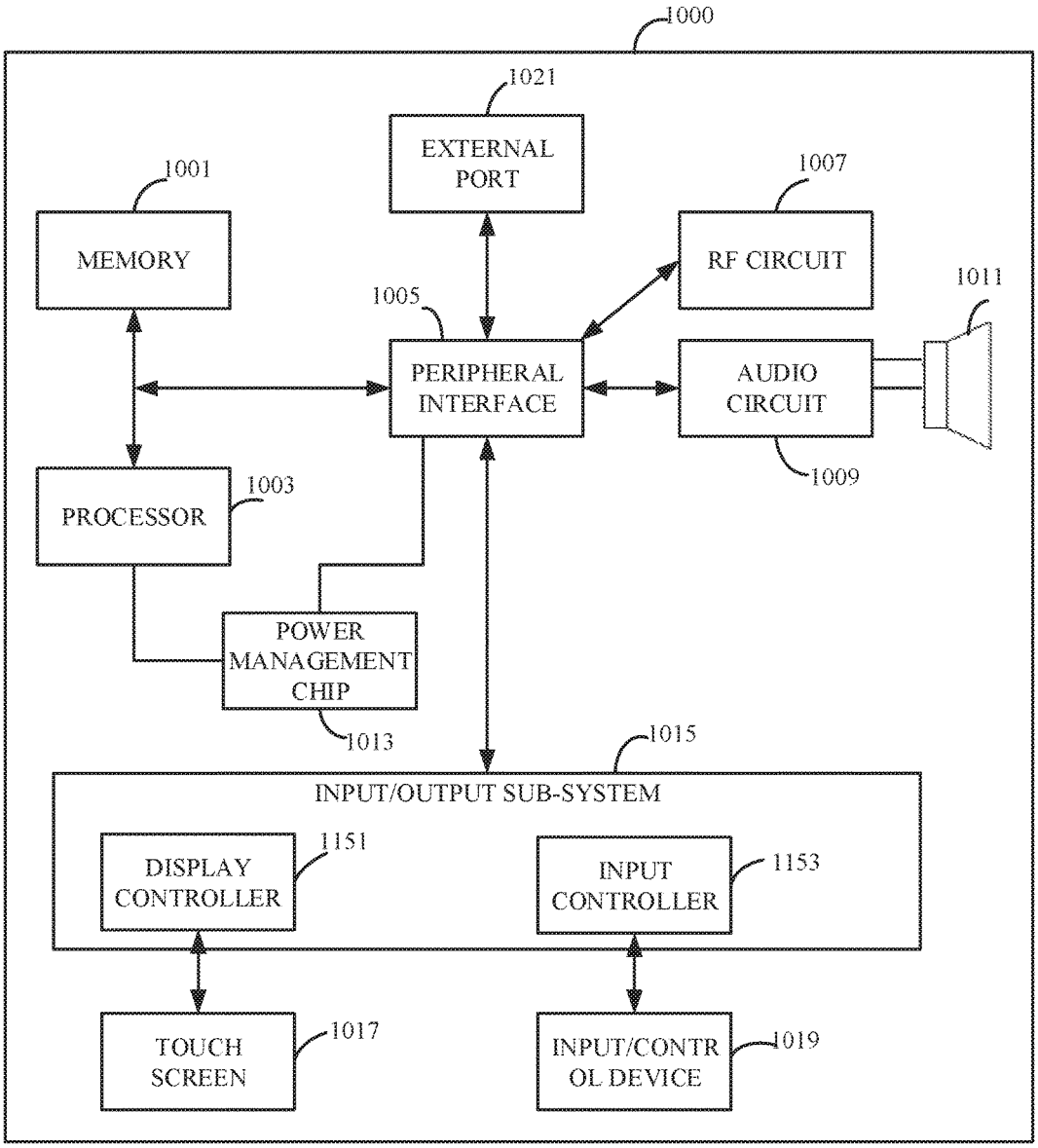
FIG. 10 is a structural view of a terminal in accordance with an implementation of the present disclosure.

FIG. 10 is a structural view of a terminal in accordance with an implementation of the present disclosure. A terminal 1000 may include a memory 1001 and a processor 1003. The memory 1001 stores computer-readable program codes. The memory 1001 may be a random access memory, a nonvolatile memory, a disk, and so on. The processor 1003 may be configured to invoke the computer-readable program codes to perform the method illustrated in FIG. 1 or the method illustrated in FIG. 8, which will not be repeated herein.

The terminal 1000 may further include a peripheral interface 1005, a radio frequency (RF) circuit 1007, an audio circuit 1009, a speaker 1011, a power management chip 1013, an input/output sub-system 1015, a touch screen 1017, an input/control device 1019, an external port 1021, and so on.

The input/output sub-system 1015 can couple the touch screen 1017 and the input/control device 1019 to the peripheral interface 1005. The input/output sub-system 1015 may include a display controller 1151 and an input controller 1153 which is configured to control the input/control device 1019. The input controller 1153 can receive electrical signals from or transmit electrical signals to the input/control device 1019. The input/control device 1019 may include physical buttons, a sliding switch, a joystick, and so on. The input controller 1153 may be coupled to a keyboard, a universal serial bus interface, a mouse, and so on.

The touch screen 1017 may be a capacitance-type touch screen, a resistance-type touch screen, a surface acoustic wave touchscreen, and so on.

The display controller 1151 may receive electrical signals from or transmit electrical signals to the touch screen 1017.

The RF circuit 1007 may be configured to establish communication between the terminal 1000 and a network.

The audio circuit 1009 may be configured to receive audio data from the peripheral interface 1005, convert the audio data into electrical signals, and transmit the electrical signals to the speaker 1011.

While the present disclosure has been described in detail above with reference to the exemplary implementations, the scope of the present disclosure is not limited thereto. As will occur to those skilled in the art, the present disclosure is susceptible to various modifications and changes without departing from the spirit and principle of the present disclosure. Therefore, the scope of the present disclosure should be determined by the scope of the claims.

What is claimed is:

1. A method for controlling image display, comprising:

determining a first image display scheme based on property information of a currently displayed image and a relationship between image property information and image display schemes, and determining a power saving level corresponding to the first image display scheme based on a relationship between power saving levels and the image display schemes, when the currently displayed scene is different from a previously displayed scene;

determining a second image display scheme based on a type of a user operation and a relationship between types of user operation and the image display schemes, and determining a power saving level corresponding to the second image display scheme based on the relationship between the power saving levels and the image display schemes;

determining the first image display scheme to be a target image display scheme when the power saving level corresponding to the first image display scheme is higher than the power saving level corresponding to the second image display scheme, and determining the second image display scheme to be the target image display scheme when the power saving level corresponding to the second image display scheme is higher than the power saving level corresponding to the first image display scheme, the target image display scheme comprising at least one parameter related to image display effects; and processing and displaying a to-be-displayed image based on the target image display scheme.

2. The method of claim 1, wherein the property information of the currently displayed image is selected from the group consisting of at least a color value and a transparency value.

3. The method of claim 1, wherein determining the target image display scheme comprises:

determining the target image display scheme every time after a preset period.

4. The method of claim 1, wherein the target image display scheme is preset based on fidelity optimized signal scaling technology.

5. A terminal, comprising:

a memory configured to store computer-readable program codes; and a processor configured to invoke the computer-readable program codes to:

determine a first image display scheme based on property information of a currently displayed image and a relationship between image property information and image display schemes, and determining a power saving level corresponding to the first image display scheme based on a relationship between power saving levels and the image display schemes, when the currently displayed scene is different from a previously displayed scene;

determine a second image display scheme based on a type of a user operation and a relationship between types of user operation and the image display schemes, and determining a power saving level corresponding to the second image display scheme based on the relationship between the power saving levels and the image display schemes;

determine the first image display scheme to be a target image display scheme when the power saving level corresponding to the first image display scheme is higher than the power saving level corresponding to the second image display scheme, and determining the second image display scheme to be the target image display scheme when the power saving level corresponding to the second image display scheme is higher than the power saving level corresponding to the first image display scheme, the target image display scheme comprising at least one parameter related to image display effects; and process and display a to-be-displayed image based on the target image display scheme.

6. The terminal of claim 5, wherein the property information of the currently displayed image is selected from the group consisting of at least a color value and a transparency value.

7. The terminal of claim 5, wherein the target image display scheme is preset based on fidelity optimized signal scaling technology.

8. The method of claim 1, wherein the target image display scheme is preset based on content adaptive brightness control technology.

9. A non-transitory computer-readable storage medium storing a computer program which, when executed by a processor, causes the processor to carry out actions:

determining a first image display scheme based on property information of a currently displayed image and a relationship between image property information and image display schemes, and determining a power saving level corresponding to the first image display scheme based on a relationship between power saving levels and the image display schemes, when the currently displayed scene is different from a previously displayed scene;

determining a second image display scheme based on a type of a user operation and a relationship between types of user operation and the image display schemes, and determining a power saving level corresponding to the second image display scheme based on the relationship between the power saving levels and the image display schemes;

determining the first image display scheme to be a target image display scheme when the power saving level corresponding to the first image display scheme is higher than the power saving level corresponding to the second image display scheme, and determining the second image display scheme to be the target image display scheme when the power saving level corresponding to the second image display scheme is higher than the power saving level corresponding to the first image display scheme, the target image display scheme comprising at least one parameter related to image display effects; and processing and displaying a to-be-displayed image based on the target image display scheme.

10. The non-transitory computer-readable storage medium of claim 9, wherein the property information of the currently displayed image is selected from the group consisting of at least a color value and a transparency value.

11. The non-transitory computer-readable storage medium of claim 9, wherein the computer program executed by the processor to carry out the action of determining the target image display scheme is executed by the processor to carry out actions, comprising: determining the target image display scheme every time after a preset period.

12. The non-transitory computer-readable storage medium of claim 9, wherein the target image display scheme is preset based on fidelity optimized signal scaling technology.

* * * * *